US005110228A

United States Patent [19]

Yokomizo

[11] Patent Number: 5,110,228

[45] Date of Patent: May 5, 1992

[54] CASSETTE WITH A LOOSENING PREVENTION MECHANISM

[75] Inventor: Yuji Yokomizo, Kurashiki, Japan

[73] Assignee: Mitsubishi Kasei Corporation, Tokyo, Japan

[21] Appl. No.: 631,241

[22] Filed: Dec. 20, 1990

[30] Foreign Application Priority Data

Dec. 20, 1989 [JP] Japan ..... 1-146630[U]

[51] Int. Cl.[5] ..... B41J 35/28

[52] U.S. Cl. ..... 400/208; 242/198; 242/199

[58] Field of Search ..... 400/207, 208, 208.1, 400/194, 196, 231, 242, 247; 242/198, 194, 197, 199, 200; 360/132

[56] References Cited

U.S. PATENT DOCUMENTS

| | | | |
|---|---|---|---|
| 4,341,365 | 7/1982 | Oishi | 242/199 |
| 4,368,860 | 1/1983 | Goto | 242/197 |
| 4,436,256 | 3/1984 | Saitou | 242/200 |
| 4,500,050 | 2/1985 | Oishi et al. | 242/198 |
| 4,619,420 | 10/1986 | Schoettle | 242/198 |
| 4,687,358 | 8/1987 | Saitou | 400/208 |
| 4,781,340 | 11/1988 | Shiba et al. | 242/199 |
| 4,802,044 | 7/1989 | Iwahashi et al. | 360/132 |
| 4,883,234 | 11/1989 | Yamakawa et al. | 242/198 |
| 4,899,243 | 2/1990 | Bordignow | 242/197 |
| 4,984,753 | 1/1991 | Nishimura | 242/199 |
| 5,042,740 | 8/1991 | Schoettle et al. | 242/199 |

FOREIGN PATENT DOCUMENTS

| | | |
|---|---|---|
| 60-23087 | 2/1985 | Japan . |
| 60-240482 | 11/1985 | Japan . |
| 61-1120552 | 7/1986 | Japan . |
| 62-38163 | 3/1987 | Japan . |
| 63-7558 | 1/1988 | Japan . |
| 1-64456 | 4/1989 | Japan . |

*Primary Examiner*—Eugene H. Eickholt

*Attorney, Agent, or Firm*—Oblon, Spivak, McClelland, Maier & Neustadt

[57] ABSTRACT

A cassette with a loosening prevention mechanism includes a cassette case rotatably supporting reels including a strip of medium wound therearound. Each of the reels has, at its one end, a rotation prevention portion and an outer shaft portion and, at its other end, an inner shaft portion. A resilient member is integral with the cassette case. The reel has an inner end in contact with the resilient member and is pressed toward the outer shaft portion by the resilient member. A rotation prevention mechanism is operative when the rotation prevention portion of the reel is brought into engagement with a rotation stop portion formed on an inner peripheral wall of said cassette case, and inoperative when a force applied from the outer shaft portion toward the inner shaft portion of the reel is greater than a pressing force by the resilient member.

20 Claims, 6 Drawing Sheets

CASSETTE WITH A LOOSENING PREVENTION MECHANISM

BACKGROUND OF THE INVENTION

1. Field of the Invention

The present invention relates to a cassette including a strip of medium with a mechanism for preventing loosening of the strip.

2. Background of the Related Art

A conventional cassette includes two reels rotatably mounted in parallel, and a strip of medium supplied from one of the two reels and taken up by the other reel. A mechanism is included to prevent the reel from rotating so that the strip may not be loosened when the cassette is not in use. In Japanese laid-open publication No. 60/23087, for example, a cassette case has an integral spring portion pressed against the side of a reel. The resulting friction prevents the strip from being loosened. Also, U.S. Pat. No. 4,687,358, and Japanese laid-open utility model publication No. 61/120552 disclose cassettes in which a flexible piece is pressed into the interior of a cassette case so as to make a reel free to rotate when in use. Japanese laid-open utility model publication No. 62/38163 discloses a cassette in which a reel includes a spring to make the reel free to rotate. In Japanese laid-open utility model publication No. 63/7558, a discrete stopper is inserted to prevent a strip of medium from being loosened. U.S. Pat. No. 4,883,234 discloses a cassette within which a rotation prevention piece extends between the front ends of lead springs.

However, in Japanese laid-open patent publication No. 60/23087, for example, a force is equally exerted when the cassette is in use and when the cassette is not in use. It is difficult to apply an appropriate amount of force in either case. The other prior art cassettes require a greater number of parts, are complicated in structure, and require more manufacturing processes. This makes it difficult to produce the cassettes and results in an increase in the production cost.

SUMMARY OF THE INVENTION

It is an object of the present invention to provide a cassette wherein a reel has a rotation prevention mechanism integrally formed with a cassette case.

It is a further object of the invention to provide a cassette which functions to fully prevent a strip of medium from being loosened without adding parts and providing a complicated structure.

It is a further object of the present invention to provide a cassette with a mechanism for preventing loosening of a strip of medium which is simple in structure and easy to manufacture.

The foregoing objects of the present invention are readily achieved by a cassette with a loosening prevention mechanism which comprises a cassette case, reels rotatably mounted within the cassette case and having a strip of medium wound therearound, each of the reels having a rotation prevention portion and an outer shaft portion supported by a bearing portion of the cassette case. A resilient member is integral with the cassette case. The reel has an end (hereinafter referred to as an inner end) where an inner shaft portion is formed and contacts the resilient member while being pressed toward the outer shaft portion by the resilient member. The rotation prevention mechanism is operative when the resilient member presses the reel into engagement with a rotation stop portion formed on an inner peripheral wall of the cassette case, and is inoperative when a force applied from the outer shaft portion toward the inner shaft portion of the reel is greater than a pressing force by the resilient member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
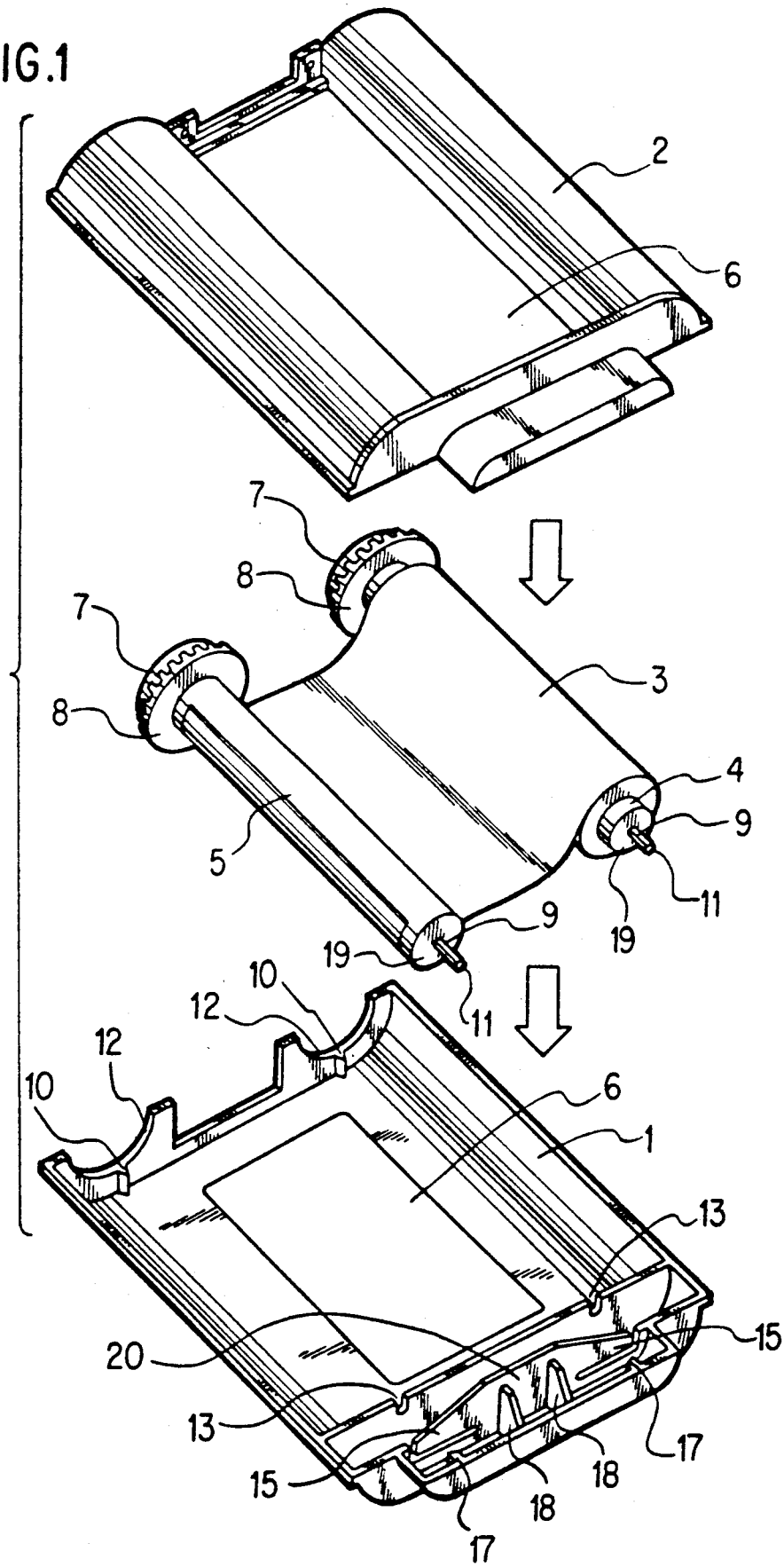
FIG. 1 is an exploded view diagrammatically illustrating a cassette according to one embodiment of the present invention.

The present invention will now be described with reference to the drawings. In the illustrated embodiments, the present invention is applied to a cassette used for a thermal printer and includes a thermal transfer film. The present invention is not limited to a cassette for use with such a thermal transfer film, but is applicable to a cassette for use with any type of medium in the form of a strip.

In the drawings, 1 and 2 are halves of a cassette case. A thermal transfer film 3 is supplied by a reel 4. A reel 5 is adapted to take up the thermal transfer film. Openings 6 are formed in the cassette case halves 1 and 2. The reels 4 and 5 are rotatably and axially movably mounted within the cassette case formed by the halves 1 and 2. The reels 4 and 5 are identical in structure, and only the reel 4 shown in FIG. 1 will be described in detail.

Figure 2:
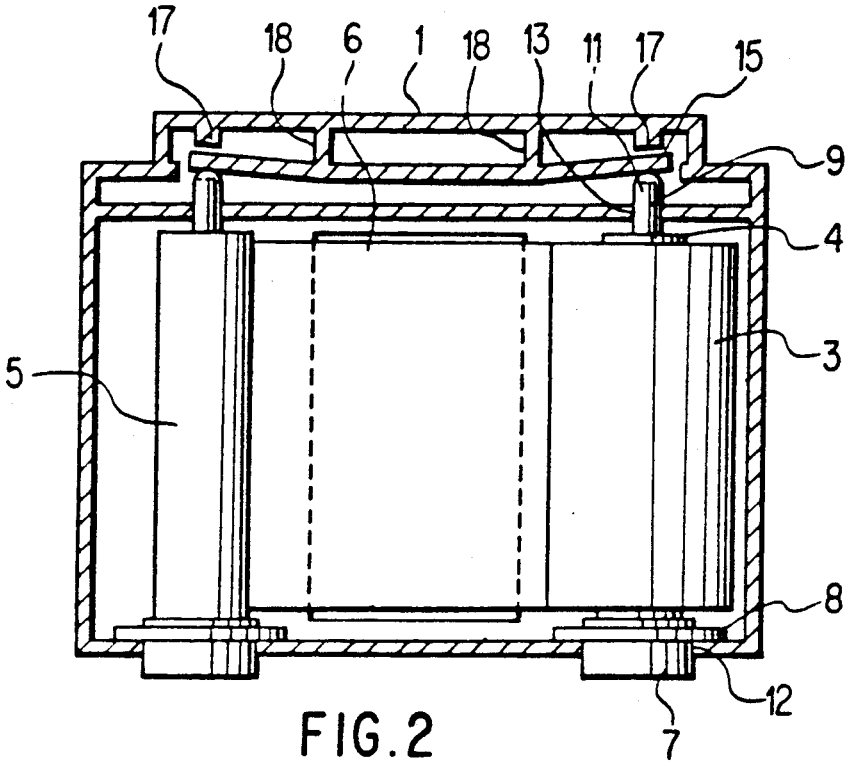
FIGS. 2 and 3 are sectional views of a cassette case with reels mounted and showing different operating conditions of the cassette.

The reel 4 includes an outer shaft portion 7 and a rotation prevention portion 8 at its one end (lower end in FIG. 2) and an inner shaft portion 9 at its other end (upper end in FIG. 2). The cassette case formed by halves 1 and 2 has an opening or bearing portion 12. The outer shaft portion 7 is supported by the bearing portion 12 and extends outwardly from the cassette case. The outer shaft portion 7 is adapted to engage with a shaft 16 of a thermal printer or the like.

Figure 4:
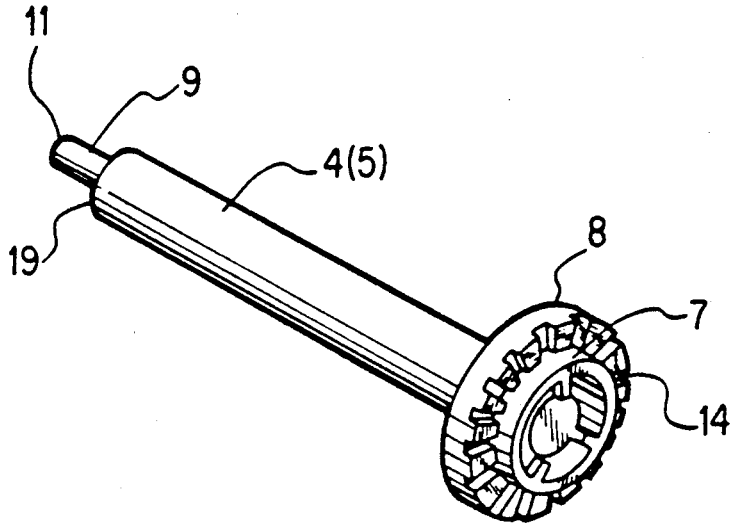
FIG. 4 is a perspective view of the reel only.

A rotation prevention mechanism includes a rotation stopper 10 formed on the inner peripheral wall of the cassette case and engageable with the rotation prevention portion 8. The mechanism is not limited to such an arrangement and may take any other form by which rotation of the reel can be prevented. For example, the mechanism may include a combination of concave ad convex elements or a combination of grooves and claws. Specifically, the rotation prevention portion 8 is pressed against the rotation stopper or claw 10 formed on the inner peripheral wall of the cassette so as to stop rotation of the reel. As shown in FIG. 4, the rotation prevention portion 8 has recesses 14 with which the rotation stopper or claw 10 is engaged.

The inner shaft portion 9 extends from one end (upper end in FIG. 2) of the reel and is supported by a bearing portion 13 formed in the cassette case. The bearing portion 13 is in the form of an opening slightly greater in diameter than the inner shaft portion 9 of the reel 4.

In the present embodiment, the inner end of the reel 4 includes a projection 11 of the inner shaft portion and a shoulder portion 19. In this embodiment, the projection 11 is always held in contact with a resilient member 15 as shown in FIGS. 1 to 3 and 6 to 8.

Figure 3:
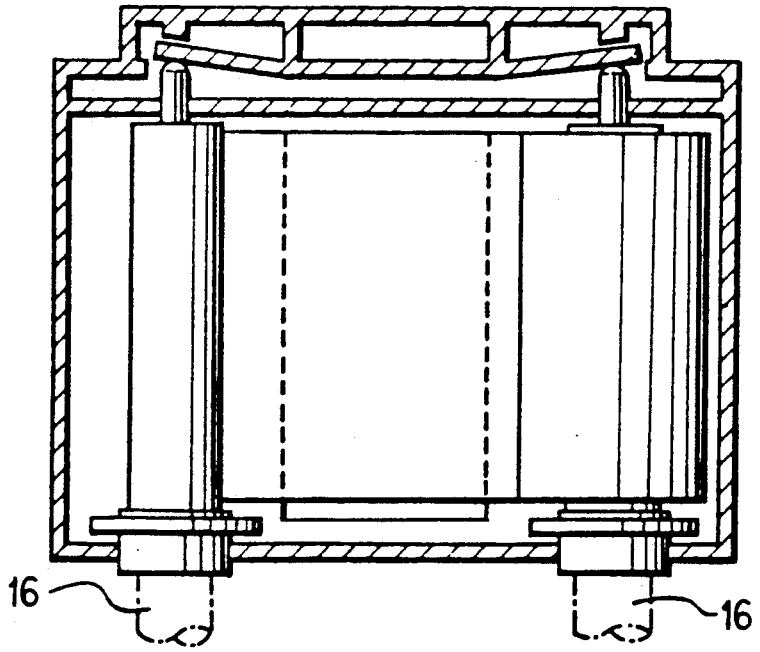

FIGS. 2 and 3 are sectional views showing the operation of a mechanism for prevention the film from being loosened when the reels are mounted within the cassette of FIG. 1.

In FIG. 2, the projection 11 is urged by the resilient member 15 mounted to the cassette half 1 so that the reel 4 may be pressed toward the outer shaft portion 7. This causes the rotation prevention portion 8 to engage with the rotation stopper or claw 10 so as to prevent the reel 4 from rotating. In FIG. 3, the reel 4 is moved from the outer shaft portion 7 toward the inner shaft portion 9 by an external force such as the shaft 16 of the printer or the like. The rotation prevention portion 8 is then disengaged from the rotation stopper or claw 10 so as to allow the reel to rotate.

In the present invention, the resilient member 15 is made of any material and takes any shape, so long as it can be integrally formed with the cassette case half 1, is resilient to press the inner end 9 of the reel 4 so as to prevent the reel 4 from rotating, and can be slightly deformed without losing its resiliency and strength when it is pressed back by the reel 4 so as to allow the reel to rotate. For this purpose, the resilient member 15 or the cassette case may be made of synthetic resins such as acetyl cellulose, cellulose butyrate, nylon 6, nylon 6—6, acryl, low density polyethylene, high density polyethylene, soft polyvinyl chloride, hard polyvinyl chloride, polystyrene, acrylonitrile-styrene acrylonitrile-styrene copolymer, acrylonitrile-butadiene-styrene copolymer, polyacetal, polycarbonate, and polybutylene telephthalate. Such synthetic resins should be suitable for injection molding.

At least one portion of the resilient member 15 is fixed to the cassette case half 1. The resilient member 15 has an end (referred to as a free end) slightly displaceable when contacted with the inner end 9 of the reel 4. The resilient member 15 is preferably shaped so that a portion between its fixed portion and free end may have an appropriate resiliency and strength. It should be noted that when the resilient member has a high resiliency, for example, a portion of the resilient member in contact with the inner end 9 is not necessarily the free end of the resilient member 15. When the resilient member has a low resiliency, two resilient members 15 of different shape may be placed one above the other so as to contact inner ends of the reel. This arrangement reinforces the resilient members 15.

Figure 5:
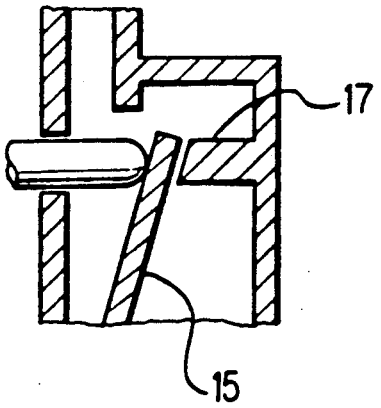
FIG. 5 is an enlarged view showing the manner in which a resilient member is pressed against a stopper by a projection of an inner shaft portion of the reel.

As shown in FIG. 1, the resilient member 15 has a partition 20. The partition 20 has L-shaped slits to provide free ends in contact with the projection 11 of the reel 4. The resilient member 15 thus made has the necessary resiliency and strength. The resilient member 15 is simple in structure and can thus be easily integrated with the cassette case 1. For the purpose of reinforcing the structure, reinforcing members 18 are added to support fixed portions of the partition 20 and the cassette case 1. As shown in FIG. 5, it is preferred that stoppers 17 extend from the inner surface of the cassette case 1 so as to support the resilient member 15 when the projection 11 is moved to allow the reel to rotate while bending the resilient member 15 to a full extent. This arrangement is intended to improve the strength and impact resistance of the resilient member 15.

A portion of the resilient member 15 may be fixed to any part of the lateral sides, front and bottom of the cassette case half 1 so long as the foregoing requirements are met. The front of the cassette case 1 is a side wall thereof adjacent to the inner shaft portion.

The resilient member 15 is in the form of a plate, but may have a U-shaped or V-shaped configuration, or may take any other shape such as spiral, so long as a portion of the resilient member 15 in contact with the inner end 9 of the reel provides resiliency.

Figure 6:
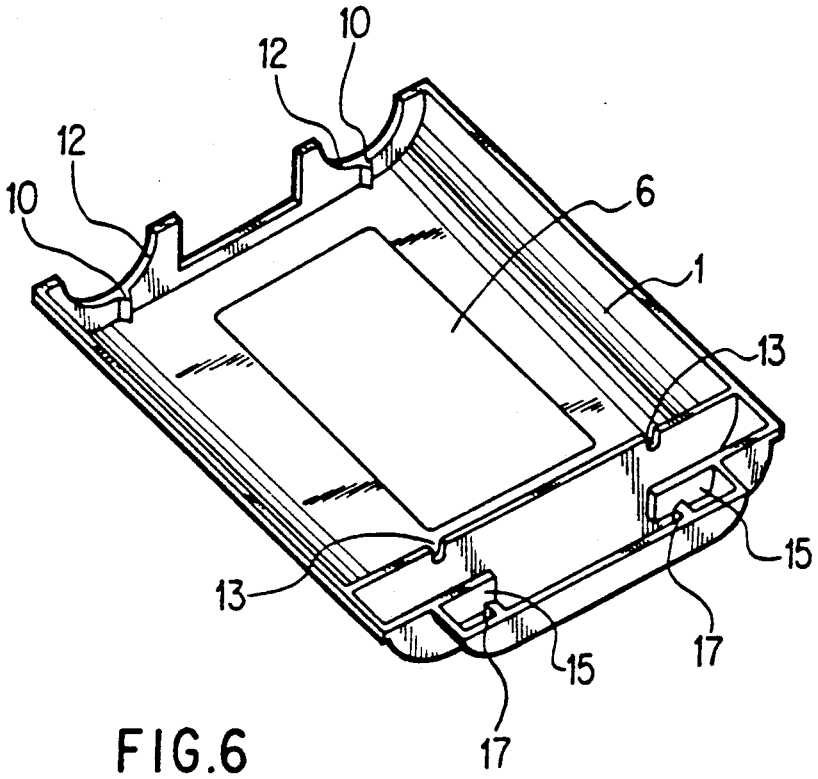
FIGS. 6 to 8 illustrate embodiments of the cassette including resilient members of different shapes.
Figure 7:
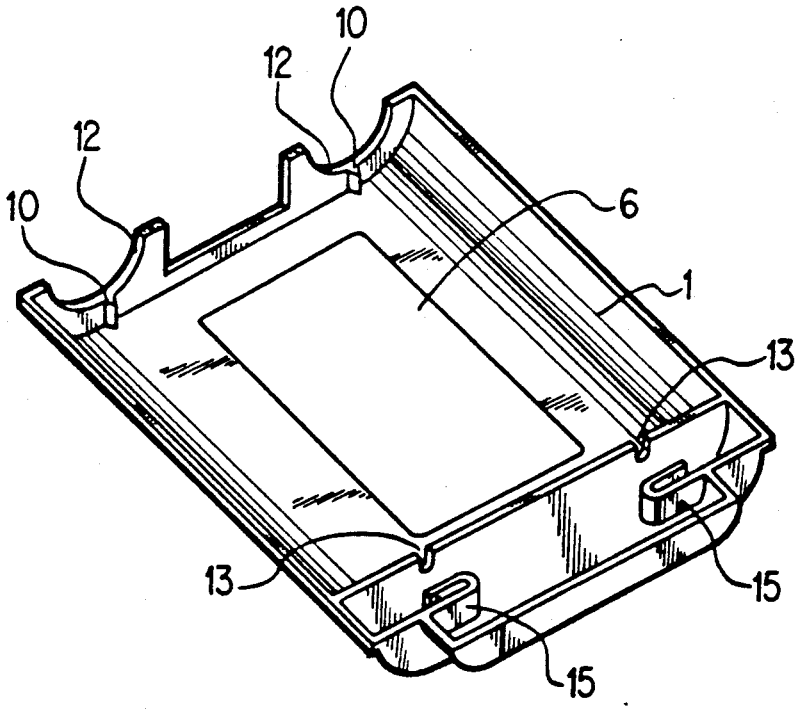
Figure 8:
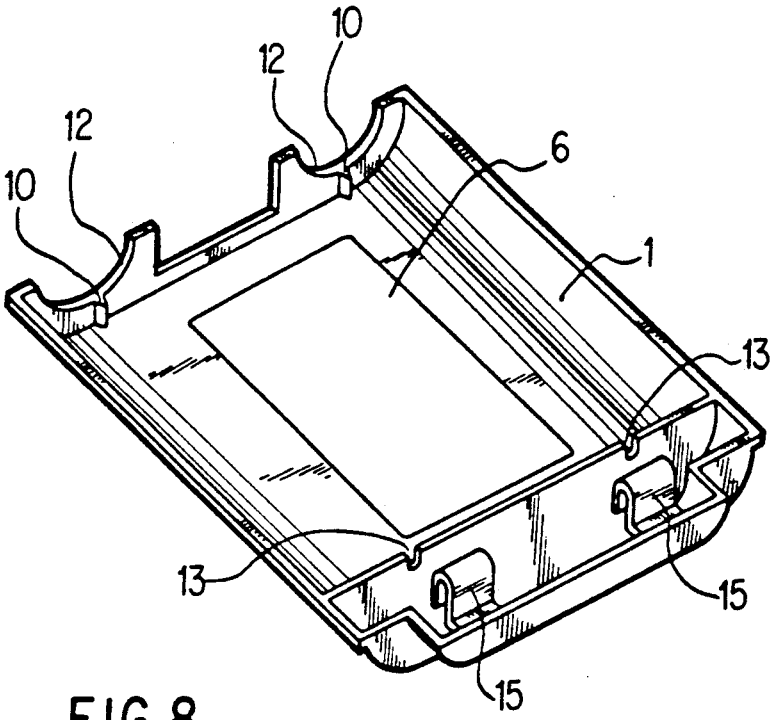
Figure 9:
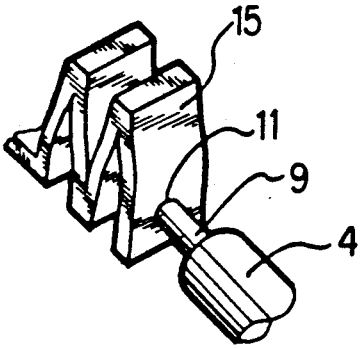
FIGS. 9 and 10 show the manner in which an inner end of the reel is in contact with the resilient member.
Figure 10:
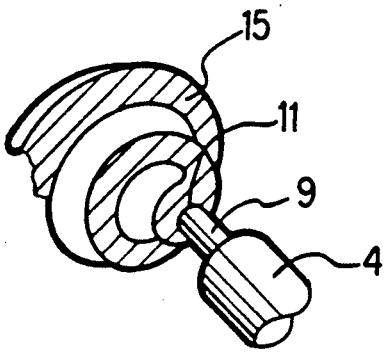

In FIG. 6, for example, the resilient members 15, each in the form of a plate, extend from the lateral sides of the cassette case 1. In FIG. 7, the U-shaped resilient members 15 are joined to the lateral sides of the cassette case 1. In FIG. 8, the U-shaped resilient members 15 are joined to the front of the cassette case 1. In FIG. 9, the resilient member 15 has a V-shaped configuration. In FIG. 10, the resilient member is spiral in shape.

Figure 11:
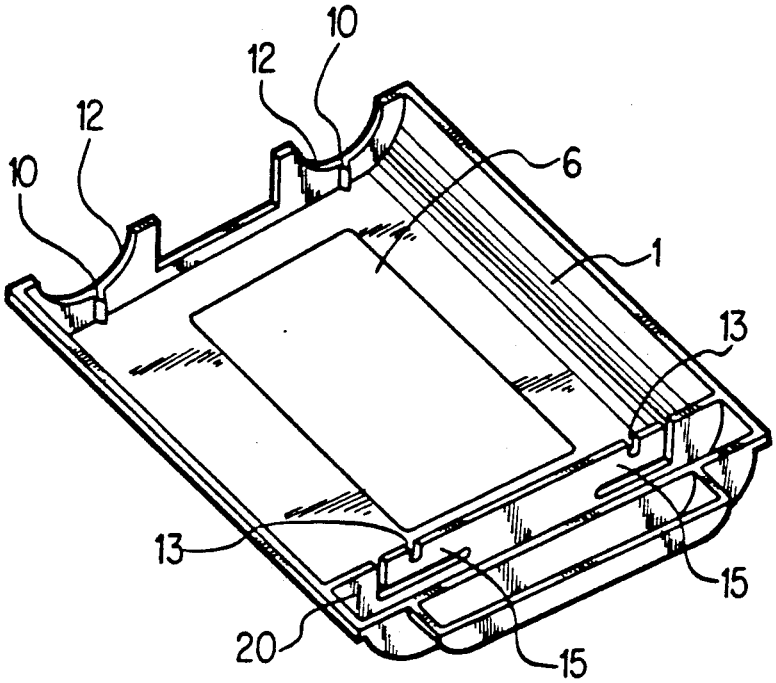
FIG. 11 illustrates one example of a cassette case.

In another embodiment of the present invention, the reel 4 has a boundary surface or shoulder portion 19 joined to the inner shaft portion 9 of the reel 4 and adapted to always contact the resilient member 15. In this case, the resilient member 15 should include bearing portion 13 to support the inner shaft portion 9 of the reel 4. The shoulder portion 19 of the reel 4 is smooth. In FIG. 11, for example, the partition 20 of the cassette case 1 has bearing portions 13 and partly serves as the resilient member 15.

Figure 12:
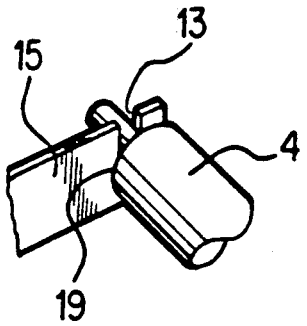
FIG. 12 shows the manner in which a shoulder portion of the reel is in contact with the cassette case of FIG. 11.

FIG. 12 is an enlarged view showing the manner in which the shoulder portion 19 of the reel 4 is in engagement with the bearing portion 13 of the resilient member 15.

As discussed above, no external force is applied to the reel 4 when the cassette of the present invention is not in use. The rotation prevention portion 8 of the reel 4 is pressed against the rotation stopper or claw 10 of the cassette case under the influence of the resilient member 15 so as to stop rotation of the reel 4. This is also the case with the reel 5. In this way, loosening of the thermal transfer film is prevented. When the cassette is loaded into the printer and the like, the rotation prevention portion 8 is disengaged from the rotation stopper or claw 10 so as to make the reels 4 and 5 free to rotate. This allows the thermal transfer film 3 or other medium to move.

With the cassette of the present invention, no special operation is necessary to stop the reel. Unloading of the cassette from the printer and the like automatically stops rotation of the reel so as to prevent a strip of medium from being loosened. The invention also eliminates the need for springs conventionally used in the cassette. This not only facilitates automatic loading of the cassette, but also reduces the number of parts, and thus the production cost of the cassette.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A cassette with a loosening prevention mechanism, comprising:

a cassette case having a resilient member integrally formed therewith; and a plurality of reels rotatably supported within said cassette case and having a strip of medium wound therearound, each of said reels comprising:

a) an outer end having an outer shaft portion to which an external force may be applied, b) an inner end engaged by said resilient member such that said resilient member presses said reel towards said outer end and onto a bearing portion of said cassette case, and c) rotation prevention means for preventing rotation of said reel when said resilient member presses said reel toward said outer end and for permitting rotation of said reel when an external force moves said reel toward said inner end in opposition to said resilient member.

2. A cassette with a loosening prevention mechanism according to claim 1, wherein said resilient member extends from lateral sides of said cassette case.

3. A cassette with a loosening prevention mechanism according to claim 1, wherein said resilient member extends from a front of said cassette case.

4. A cassette with a loosening prevention mechanism according to claim 1, wherein said resilient member extends from a bottom of said cassette case.

5. A cassette with a loosening prevention mechanism according to claim 1, further including a reinforcing member fixed between said cassette case and said resilient member.

6. A cassette with a loosening prevention mechanism according to claim 1, wherein said resilient member has free ends in contact with the inner ends of said reels.

7. A cassette with a loosening prevention mechanism according to claim 1, wherein said resilient member is in the form of a partition plate.

8. A cassette with a loosening prevention mechanism according to claim 1, wherein said resilient member has a U-shaped or V-shaped configuration.

9. A cassette with a loosening prevention mechanism according to claim 1, wherein said resilient member has a partition, and said resilient member is part of said partition.

10. A cassette with a loosening prevention mechanism according to claim 1, wherein said partition of the cassette case has slits located so that said resilient member has free ends in contact with the inner ends of said reels.

11. A cassette with a loosening prevention mechanism according to claim 1, wherein said cassette case has stoppers for limiting the bending of said resilient member.

12. A cassette with a loosening prevention mechanism according to claim 1, wherein said inner end of said reel in contact with said resilient member includes a projection.

13. A cassette with a loosening prevention mechanism according to claim 1, wherein said inner end of said reel in contact with said resilient member includes a shoulder portion of said reel.

14. A cassette with a loosening prevention mechanism according to claim 1, wherein said strip of medium is a thermal transfer film.

15. A cassette with a loosening prevention mechanism according to claim 1, wherein said loosening prevention member is positioned at said outer end of the reel.

16. A cassette as according to claim 7, wherein said partition plate has L-shaped slits to form resilient free ends contacting the inner ends of said reels.

17. A cassette as according to claim 16, wherein said reinforcing member is positioned for reinforcing said partition plate.

18. A cassette as according to claim 1, wherein said rotation prevention means is formed at ends of said reels opposite said resilient member.

19. A cassette as according to claim 18, wherein said rotation prevention means is further formed on said cassette case.

20. A cassette as according to claim 19, wherein said rotation prevention means comprises a claw formed on an inner wall of said cassette case.

* * * * *